US005440763A

United States Patent [19]

Shah et al.

[11] Patent Number: 5,440,763

[45] Date of Patent: Aug. 15, 1995

[54] MULTI-PURPOSE GOWN

[75] Inventors: Ramesh M. Shah, Indianapolis; Robert J. Demeter, Mooresville, both of Ind.

[73] Assignees: DataChem, Inc.; Methodist Hospital of Indiana, Inc., both of Indianapolis, Ind.

[21] Appl. No.: 339,001

[22] Filed: Nov. 14, 1994

[51] Int. Cl.[6] ..... A41D 13/00

[52] U.S. Cl. ..... 2/114; 2/105; 2/106; 2/69; 2/912; 2/913

[58] Field of Search ..... 2/46, 48, 49.1, 49.2, 2/49.3, 49.4, 49.5, 50, 51, 52, 69, 69.5, 73, 104, 105, 106, 113, 114, 115, 912, 913, 914, 915

[56] References Cited

U.S. PATENT DOCUMENTS

| | | | |
|---|---|---|---|
| 1,462,515 | 7/1923 | McElroy . | |
| 2,661,472 | 12/1953 | Miller | 2/74 |
| 3,464,063 | 9/1969 | Hoergerman | 2/114 |
| 4,031,566 | 6/1977 | Johnson | 2/104 |
| 4,458,365 | 7/1984 | Wood | 2/104 |
| 4,494,248 | 1/1985 | Holder | 2/114 |
| 4,513,451 | 4/1985 | Brown | 2/69 |
| 4,524,463 | 6/1985 | Ogden | 2/105 |
| 4,683,595 | 8/1987 | Cash | 2/105 |
| 4,718,124 | 6/1988 | Sawicki et al. | 2/114 |
| 4,759,083 | 7/1988 | Belcher | 2/114 |
| 4,819,275 | 4/1989 | Lunt | 2/114 |
| 5,093,932 | 3/1992 | Doyle | 2/114 |
| 5,097,535 | 3/1992 | Dye et al. | 2/114 |
| 5,097,536 | 3/1992 | Cohen | 2/114 |
| 5,133,086 | 7/1992 | Truitt et al. | 2/114 |
| 5,182,813 | 2/1993 | Booze | 2/104 |
| 5,228,141 | 7/1993 | Remsky et al. | 2/114 |

OTHER PUBLICATIONS

"A Cape Worth Examining" advertisement, Graham Medical, publication date uncertain.

"Treatment Gown" advertisement, Kramex, publication date uncertain.

*Primary Examiner*—Jeanette E. Chapman

*Attorney, Agent, or Firm*—Baker & Daniels

[57] ABSTRACT

A multi-purpose gown comprising a front and a back defining a body portion having arm openings and a neck opening. The front portion is dividable into a plurality of segments by various openings releasably closable by a plurality of fasteners. A strap extends in the front of the gown from the top to the bottom of the gown. The strap includes fasteners for attachment to fasteners arranged on the front portions of the gown. Alternatively, the gown may embody a front having overlapping panels that cover the abdomen, wherein each panel has an upper segment adapted to cover a breast, side, and front shoulder region of the wearer. The upper segments are releasably joined to the back by fasteners at the shoulder edges of the gown. When either one of these segments is in its open position, portions of the patient's chest, front shoulder and side torso regions are exposed, while minimizing body exposure and maintaining structural stability of the gown.

7 Claims, 7 Drawing Sheets

MULTI-PURPOSE GOWN

BACKGROUND OF THE INVENTION

This invention relates generally to multi-purpose gowns. More particularly, this invention relates to multi-purpose gowns having releasably fastenable portions that allow efficient access to selected portions of a person's anatomy, while minimizing the person's bodily exposure.

Medical gowns are frequently worn by patients undergoing certain medical procedures. In many common medical procedures, such as mammography, echocardiography and ultrasonography, it is necessary for the physician or medical technician to have direct access to specific portions of a patient's anatomy. Many conventional medical gowns do not allow convenient access to the pertinent body regions. Hence, it is frequently necessary for the patient to uncover large portions of the body in order to provide access to relatively small portions of the body. Such maneuvering of the medical gown may also impede the medical examination. Additionally, a patient may suffer embarrassment from being partially unclothed, and discomfort from being exposed to the cool-air of an examination room.

In order to overcome these disadvantages, medical gowns have been developed that allow access to specific body regions while attempting to minimize the patient's exposure. Some medical gowns utilize releasably fastenable flaps that cover only select areas of a patient's anatomy, such as the chest or the abdomen regions. U.S. Pat. Nos. 5,097,536 and 5,133,086 exemplify such gowns. These gowns allow the medical examiner to open the gown to expose selected body portions, thereby facilitating the examination.

However, current medical examination gowns preclude a wide range of uses and are often inefficient. For example, with respect to an examination of the breasts and upper chest region, prior art gowns do not allow convenient and efficient simultaneous, unencumbered access to the front shoulder, breast and side torso regions of a patient. Also, such gowns are not typically designed to provide for concurrent or alternative abdominal examination.

Additionally, some current medical examination gowns are structurally unstable during use. Such gowns fail to effectively distribute the weight of the gown when the flaps are in their "open" positions. This may cause the gown to gape or awkwardly hang about the patient, oftentimes interfering with the medical examination. Further, the weight of the gown is sometimes carried against the patient's neck, thereby causing a garroting type of discomfort. Also, the gown may completely fall away from the patient during the examination, causing embarrassment and discomfort.

Therefore, it is desired to provide a gown that is amenable to a multiplicity of uses, such as a medical gown, and that provides convenient access to any one of numerous selected portions of the patient's anatomy. Such a gown would allow access to the entire front shoulders, chest and abdomen, as well the side torso regions. Further, such a gown would be structurally stable during an examination while minimizing the patient's exposure.

SUMMARY OF THE INVENTION

The problems associated with the prior art medical gowns are solved by the features of the present invention. The present invention, in one form thereof, provides a gown having a front portion having upper and side edges. The front portion is subdivided by a vertically disposed opening to define a left panel and a right panel. Each of these panels is subdivided by a horizontally disposed cross slit into an upper portion and a lower portion. The back portion of the gown also has upper and side edges. The back portion upper and side edges are joined to respective front portion upper and side edges to define a body portion having left and right arm openings and a neck opening. A strap having vertically aligned releasable fasteners extends downwardly along the vertically disposed opening of the front portion, and is affixed at its uppermost portion to one of the panels, generally adjacent the neck opening. Each of the left and right panels includes releasable fasteners arranged adjacent the vertically disposed opening. These fasteners are positioned in mating relationship with the fasteners on the strap, and are releasably fastenable therewith. The left and right upper and lower portions each include releasable fasteners arranged adjacent the cross slit. The fasteners on the upper portion are positioned in mating relationship with the fasteners on the lower portion and releasably fastenable therewith.

The gown of the present invention, in still another form thereof, has front overlapping panels that cover the abdomen, wherein each panel has an upper segment adapted to cover a breast, side, and front shoulder region of the patient. These upper segments are releasably joined to the back by fasteners at the shoulder edges of the gown. The overlapping panels are releasably joined to each other about the patient's waist to provide for structural stability when the upper segments are in their "open" position. Thus, effective access to a patient's chest, front shoulder, and side torso regions is thereby permitted, while similarly minimizing body exposure and maintaining the structural stability of the gown.

An advantage of the gown of the present invention is that it allows a medical examiner to perform any one of a multiplicity of possible medical examinations on a patient without requiring the patient to remove or displace large portions of the gown.

Another advantage of the gown of the present invention is that it maintains its structural stability during the medical examination.

Yet another advantage of the gown of the present invention is that it is structured such that the gown portions displaced for examination purposes do not interfere with the mechanics of the examination process.

Still another advantage of the gown of the present invention is that it is structured such that the patient's modesty and comfort are accommodated during the medical examination.

A further advantage of the gown of the present invention is that it accommodates a plurality of medical and non-medical uses.

Other advantages will become apparent upon reading the following description.

DETAILED DESCRIPTION OF THE INVENTION

Figure 1:
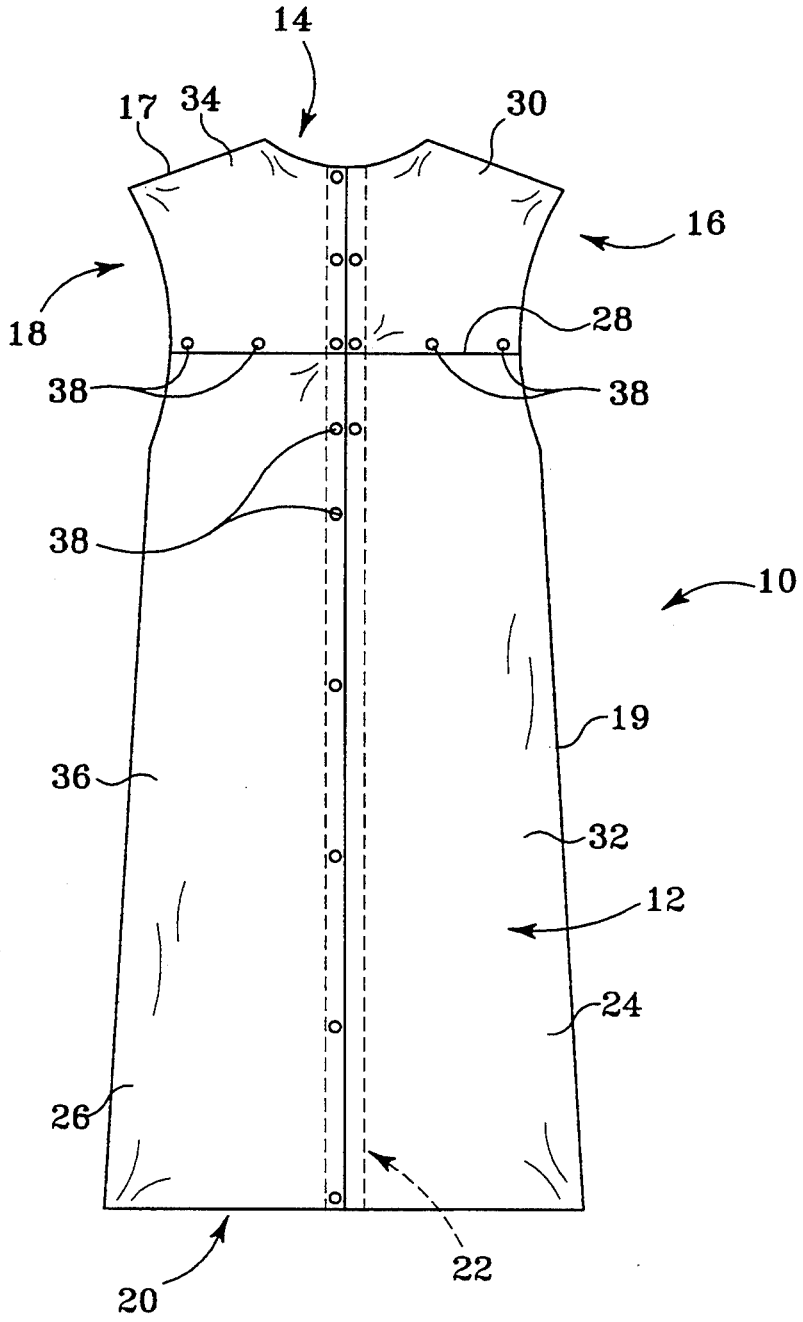
FIG. 1 is a front view of a gown that embodies the principles of the invention.

The embodiments herein described are not intended to exhaust or limit the invention to the precise forms disclosed. The embodiments are chosen and described to explain the principles of the invention and its application and practical use to enable others skilled in the art to utilize the invention.

Referring now to FIGS. 1–4, there is shown an embodiment of a multi-purpose gown 10 in accordance with the present invention. For descriptive purposes, gown 10 generally includes front portion 12, back portion 13, neck opening 14, left arm opening 16, right arm opening 18, and lower torso opening 20. Front portion 12 and back portion 13 are joined by seams at upper edges 17 and side edges 19.

Front portion 12 is divided into a left side panel 24 and a right side panel 26. Horizontal cross slit 28 further divides left and right side panels 24, 26. Left side panel 24 is divided by cross slit 28 into left upper portion 30 and left lower portion 32. Right side panel 26 is divided by cross slit 28 into right upper portion 34 and right lower portion 36.

Figure 2:
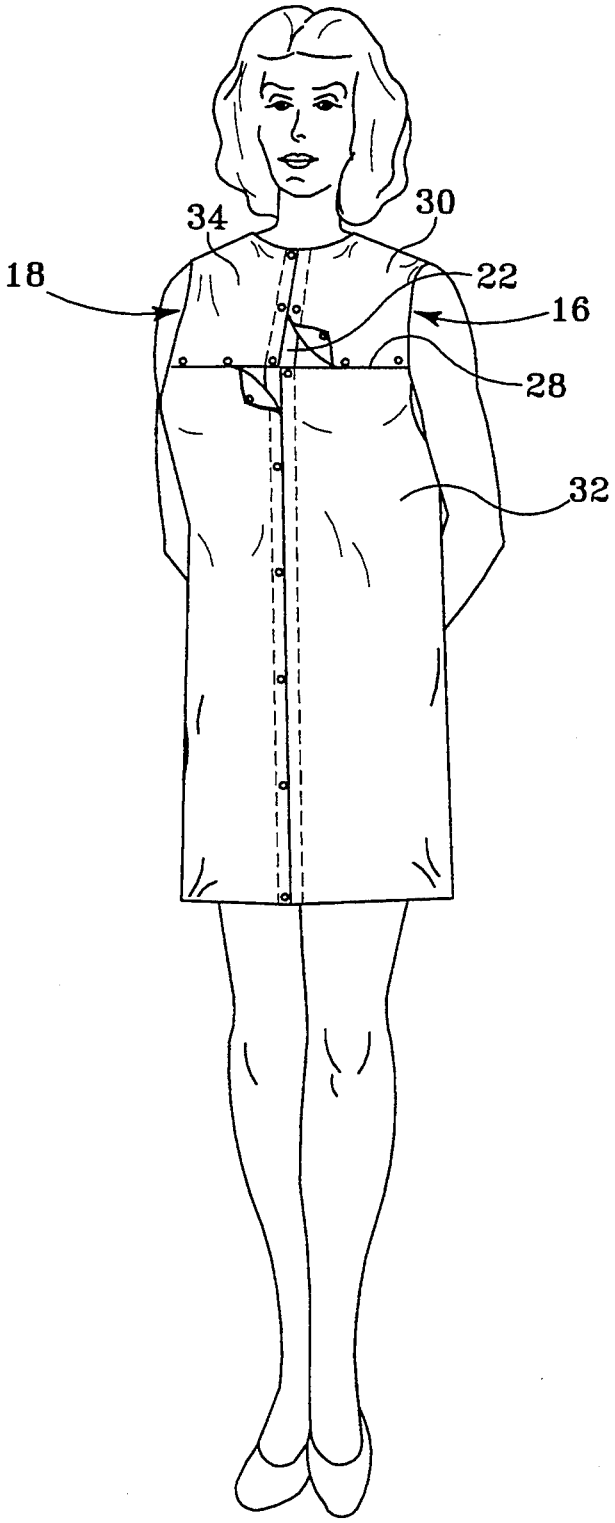
FIG. 2 is a front perspective view of the gown.
Figure 3:
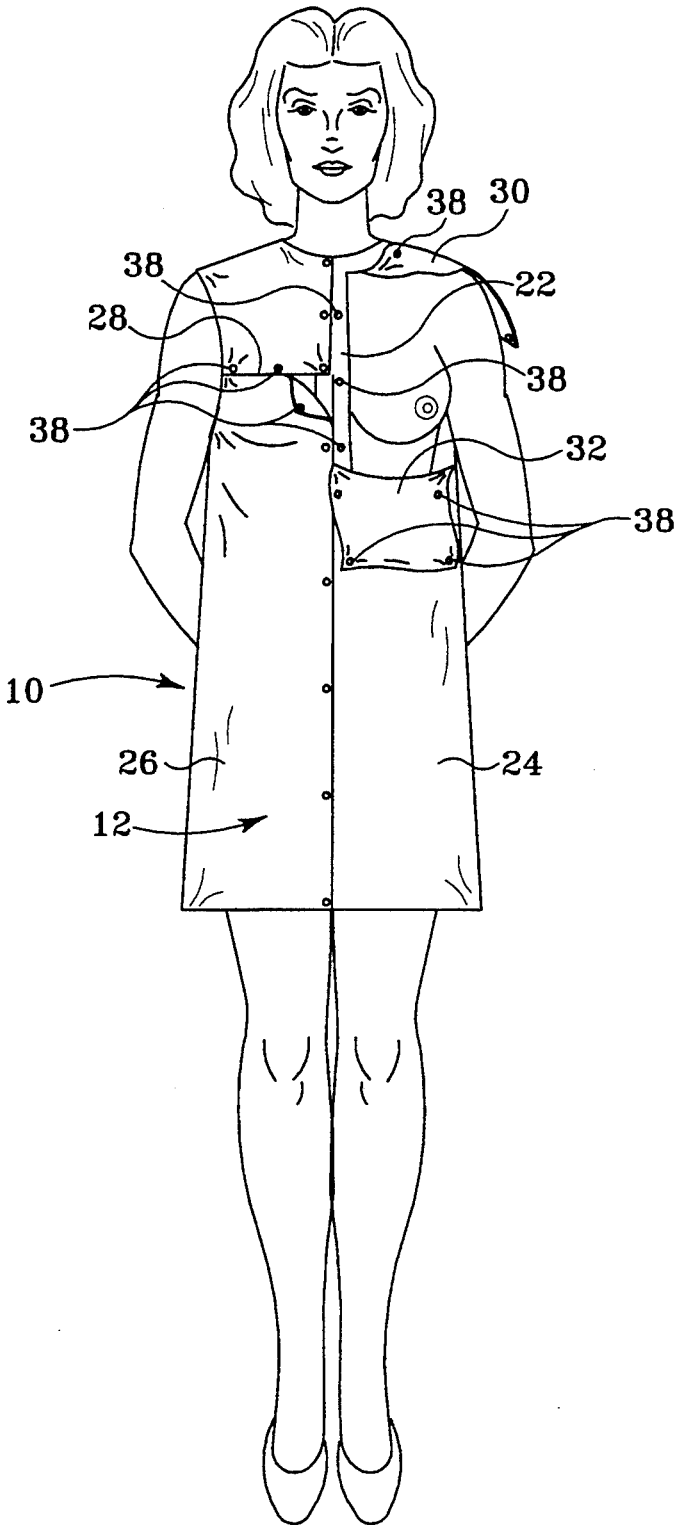
FIG. 3 is a front view of the gown showing the upper and lower portions of the left panel in the open position.

Vertically disposed strap 22 extends along the front of the gown between neck opening 14 and lower torso opening 20. Strap 22 is stitched or otherwise permanently affixed to selected upper and lower portions of left panel 24. This arrangement is best shown in FIG. 3. Starting at the uppermost vertical elevation of strap 22, this portion of strap 22 is stitched to the uppermost part of left panel upper portion 30, adjacent neck opening 14. Immediately below this stitched portion, the remaining unstitched border of upper portion 30 adjacent strap 22 is releasably attachable by way of fasteners 38 to the strap. An upper part of left panel lower portion 32 is similarly releasably attachable to strap 22 by fasteners 38. These releasably attachable portions are shown in the detached condition in FIG. 3, wherein the upper chest, left breast and a portion of the abdomen are exposed. Strap 22 is then stitched to the remaining part of lower portion 32 that borders strap 22, from the lowermost fastener 38 illustrated in the figures to lower torso opening 20. In FIG. 2, these releasably attachable portions are shown in the attached position, with the exception of the lowermost fastener 38 of left upper portion 30, which is detached. Alternatively, strap 22 may be stitched or otherwise permanently affixed to corresponding upper and lower portions of right panel 26, rather than left panel 24.

As stated, fasteners 38 are provided for releasably attaching left upper and lower portions 30, 32 to mating fasteners arranged along strap 22. Similar fasteners are provided along right upper and lower portions 34, 36 for releasable attachment to mating fasteners arranged along strap 22. As shown in FIG. 1, a greater number of fasteners are provided along right side panel 26 than along left side panel 24. Unlike the stitched connection between left side panel 24 and strap 22 at the uppermost and lowermost portions of left side panel 24 and strap 22, right side panel 26 is fully detachable from strap 22 along the entire length of the gown. On lower right side portion 36, vertically arranged fasteners 38 extend from cross slit 28 to lower torso opening 20. Similarly, at upper right side portion 34 vertically arranged fasteners extend from cross slit 28 to neck opening 14. Mating fasteners 38 are vertically disposed along strap 28. As a result, right panel 26 is selectively detachable from strap 22 along the entire common border of right panel 26 and strap 22. This arrangement enables a user to fully open the front of the gown, insert the arms and the body in the normal manner, and fasten the snaps to secure the gown.

Horizontally arranged mating fasteners 38 are disposed along the upper edge of left lower portion 32, and the lower edge of left upper portion 30, along cross slit 28. Similarly, horizontally arranged mating fasteners 38 are disposed along the upper edge of right lower portion 36 and the lower edge of right upper portion 34 along the cross slit. In FIG. 3, fasteners 38 disposed along cross slit 28 at left upper and lower portions 30, 32 are shown in the detached condition, whereby upper panel 30 is separated from lower panel 32. In this figure, fasteners 38 disposed along cross slit 28 at right side panel 26 have only been partially detached.

Fasteners 38 are preferably formed from a nonradiation penetrating material such as plastic snaps or Velcro®. Alternatively, fasteners 38 can include cotton fabric or thread buttons, loops, snaps or other well-known fastening devices.

Figure 4:
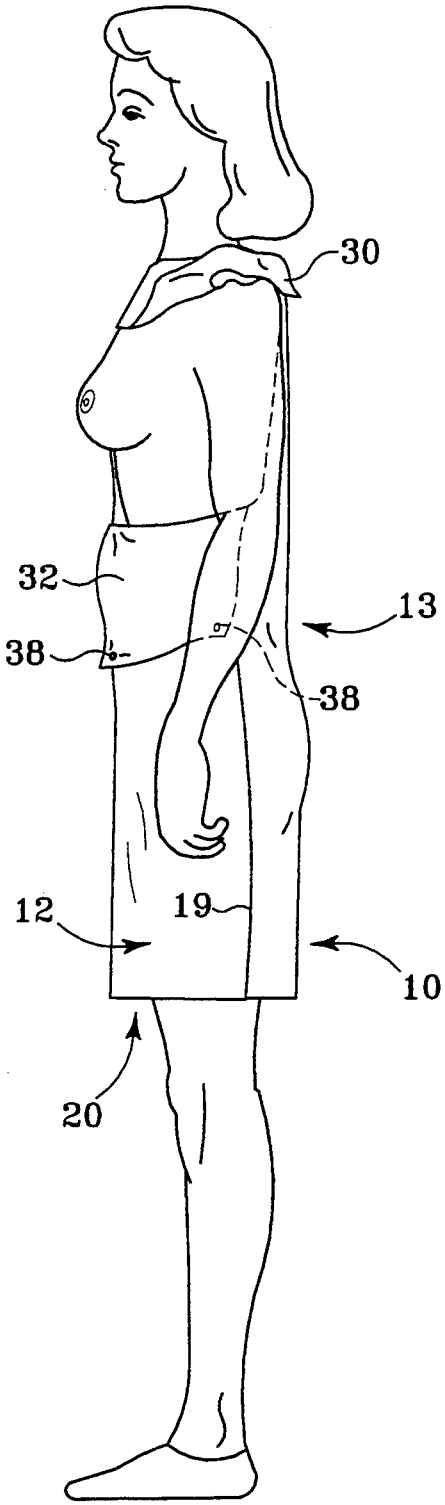
FIG. 4 is a side view of the left hand side of a person wearing the gown, wherein the left upper and lower segments are in the open position.

In the detached condition of left portions 30, 32 shown in FIGS. 3 and 4, an Examiner is able to fold portion 30 over the patient's left shoulder, thereby providing greater access to the left upper chest and shoulder regions, and the upper side torso region. At the same time, the structural stability of the gown is maintained, and other non-essential areas of the body need not be exposed for the particular examination to be performed. This arrangement is particularly beneficial to the examiner when conducting certain medical examinations, such as mammograms and echocardiograms. The arrangement is also beneficial when monitoring a test subject undergoing a treadmill test. In this event, nonintrusive monitoring instrumentation can be directly attached to the subject, and positioned such that it does not interfere with the subject's ability to perform the necessary tests.

Notwithstanding the exposure of the portions of the body shown in FIG. 3, gown 10 remains structurally stable when in this configuration, and does not gape or awkwardly hang on the patient. As a result, the gown will not droop, or otherwise fall away from the patient.

In some instances it may be preferable to only detach left lower portion 32 from strap 22 and upper portion 30. In this arrangement, upper portion 30 may remain attached to strap 22 along all or a portion of their common border. This arrangement may be preferred for particularized uses such as breastfeeding, wherein the upper portion of the breast remains covered. Right lower portion 36 may be detached from right upper portion 34 and strap 22 in a similar manner.

Gown 10 is preferably made out of conventional materials such as cotton fabric or synthetic fabric such as polyester, nylon or silk, or even paper. Gown 10 is intended to fit patients of virtually all sizes, and cover the patient from the neck to the knees, or any length as desired.

Thus, the multipurpose gown provides strategic access to selected areas of the body, while allowing other areas to remain fully covered, or virtually fully covered. The cooperating arrangement of the fasteners positioned on the side panels and on the strap, as well as the location of the cross slit and the downwardly disposed opening separating the side panels, enables portions 30, 32, 34 and 36 of the gown to be selectively arranged in a multiplicity of configurations. Any or all of said portions 30, 32, 34 and 36 may be attached or detached as desired.

For example, during a frontal chest examination, left upper and lower portions 30, 32 and right upper and lower portions 34, 36 are selectively detachable to allow an examiner access to either or both sides of the patient's chest area. Such portions are maneuverable into their respective "open" positions by releasing fasteners 38 along cross slit 28 and strap 22. One or both of left and right lower portions 32, 36 drop downwardly, as shown in FIG. 3 for left lower portion 32. One or both of left and right upper portions 30, 34 as desired, may be folded over the patient's shoulder. Accordingly, relatively small or large portions of a patient's chest, side torso and front shoulder regions may be selectively exposed. During a pelvic and/or abdominal examination, vertically arranged fasteners 38 along strap 22 are opened as desired. Left and right lower portions 32, 36 can then be maneuvered to the sides of the patient as required to allow the examiner access to the required body region. Only the lower portion of a patient's anatomy is exposed, thereby reducing patient anxiety and discomfort by minimizing exposure. The structural integrity of the gown is maintained at all times.

The stitched connection between left upper portion 30 and strap 22 provides support to prevent gown 10 from falling from the patient. Further, strap 22 assists in counterbalancing the weight of the rearwardly located portions of gown 10 from unduly pressuring the patient's neck. During an examination, the patient will remain partially covered, thereby reducing the adverse effects of embarrassment and cool-air temperatures. Further, the examiner is allowed to more efficiently conduct the examination without undue interference from gown 10 and patient anxiety or discomfort.

Figure 5:
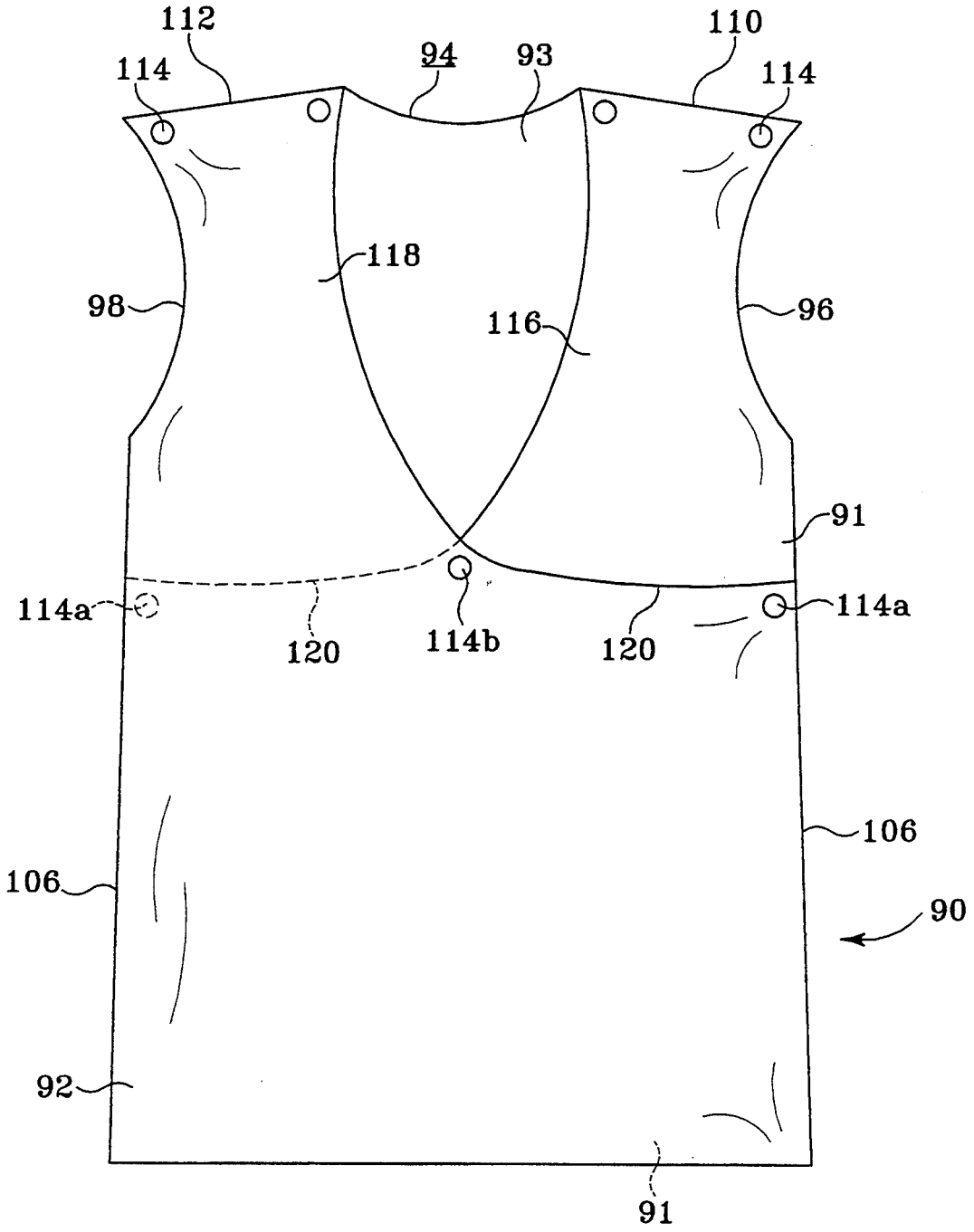
FIG. 5 is a front view of an alternate embodiment of a gown.
Figure 6:
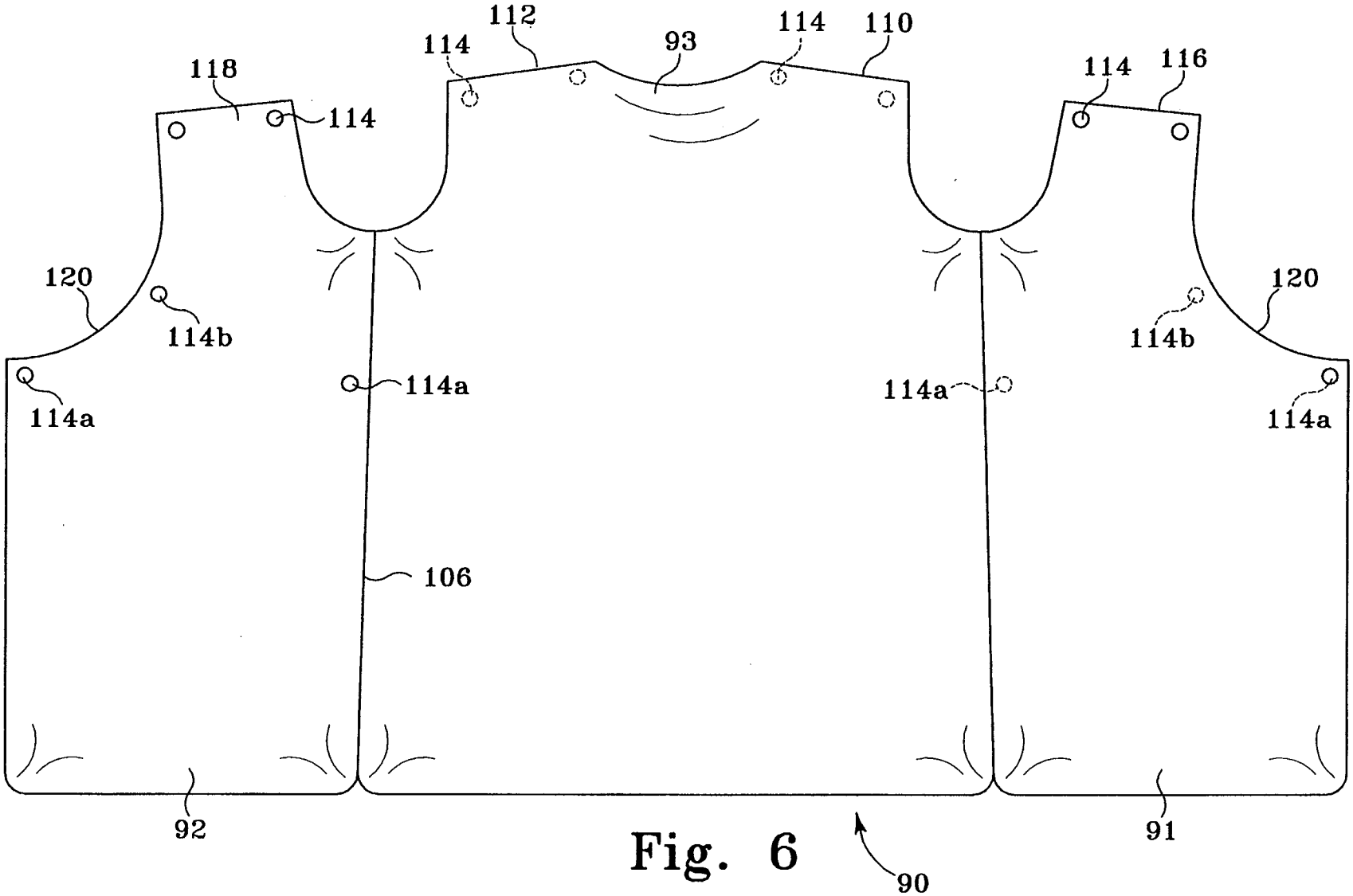
FIG. 6 is a view of the gown shown in FIG. 5 with the inner and outer front panels open and extended.
Figure 7:
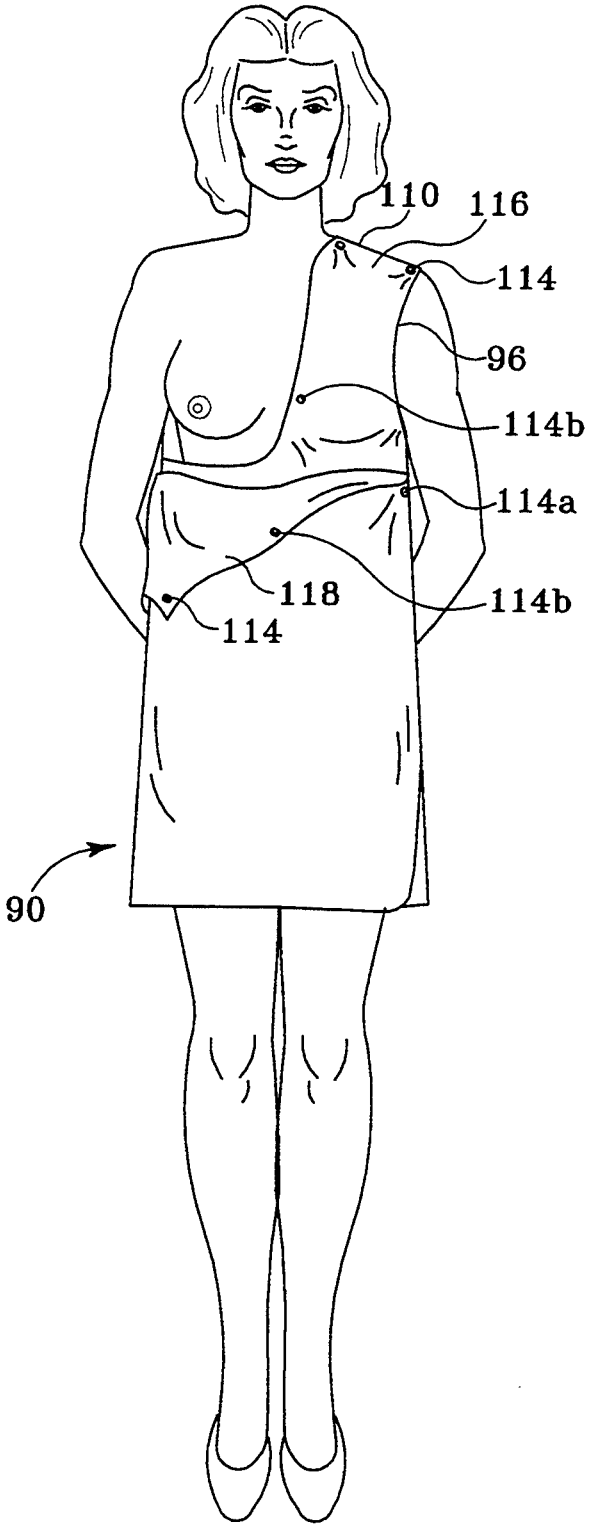
FIG. 7 is a front view of the embodiment of FIG. 5 showing a person wearing a gown with the right upper segment of the gown in the open position.

Another embodiment of the medical gown of the present invention is illustrated in FIGS. 5–7. For descriptive purposes, gown 90 generally includes inner front panel 91, outer front panel 92, and back 93. Inner and outer front panels 91, 92 are joined to back 93 along seams at side edges 106.

During use of gown 90, inner and outer front panels 91, 92 are further joined to back 93 by fasteners 114 as follows. Inner front panel 91 includes left upper segment 116, and outer front panel 92 includes right upper segment 118. Left upper segment 116 releasably attaches to back 93 at left shoulder edge 110 by fasteners 114. Similarly, right upper segment 118 releasably attaches to back 93 at right shoulder edge 112 by fasteners 114. The attachment of left and right upper segments 116, 118 to back 93 thereby defines left and right arm openings 96, 98.

Fasteners 114 are used to enable selective opening and closing of various parts of gown 90. Fasteners 114 are preferably nonradiation penetrating fasteners such as Velcro®. Alternatively, fasteners 114can include cotton fabric or thread buttons, loops, snaps or other such well-known fastening devices such as snaps.

Gown 90 is generally placed on the patient as one would place on a double-breasted coat. Left and right upper segments 116, 118 are originally attached to fasteners at back 93, thereby creating left and right arm openings 96, 98. The patient places her arms through left and right arm openings 96, 98, and then wraps inner front panel 91 across her waist. Inner front panel 91 is releasably secured to outer front panel 92 by a waist fastener 114*a*, positioned on the inside surface of panel 92. Next, outer front panel 92 is then wrapped in the reverse direction overlapping inner front panel 91. Outer front panel 92 is then releasably secured to inner front panel 91 by a waist fastener 114*a*. It should be appreciated that because of the symmetrical design of front panels 91, 92, that their inner and outer positions may be interchanged.

As best shown in FIG. 7, each one of left and right upper segments 116, 118 is designed to respectively cover one side of a patient's chest, front shoulder, and side torso region when gown 90 is being worn. Additionally, left and right upper segments 116, 118 have opposingly sloped edges 120 designed to curve under a patient's breast when inner and outer panels 91, 92 are wrapped about the patient. Specifically, sloped edges 120 gradually curve between a vertical and a horizontal slope across the patient's midsection, crossing at the patient's midchest area (FIG. 5). One or more additional fasteners 114*b* may be positioned along sloped edges 120 of each left and right upper segment 116, 118 to further secure gown 90 against exposure.

Gown 90 is preferably made out of conventional materials such as cotton fabric or synthetic fabric such as polyester, nylon or silk, or paper. Gown 90 is intended to fit patients of virtually all sizes, and cover the patient from the neck to the thighs, or any length as desired.

During a medical examination, the right breast, shoulder and side torso region may be exposed by releasing fasteners 114 located along right shoulder edge 112, as shown in FIG. 7. Right upper segment 118 falls under gravity over outer front panel 92. Access is thereby gained to a patient's chest, shoulder and side torso region. This access is beneficial to conducting medical examinations, such as mammograms and echocardiograms. Further, the placement of right upper segment 118 over outer front panel 92 reduces interference with medical examination machinery. Gown 90 will remain structurally stable on the patient because left upper segment 116 remains joined to back 93 by fasteners 114 along left shoulder edge 110. This allows the patient to remain partially covered during the examination, reducing the adverse effects of embarrassment and cool-air temperatures. Further, the examiner is allowed to efficiently conduct the examination without undue interference from, gown 90 and patient anxiety or discomfort.

Gown 90 is additionally secured about the patient by waist fasteners 114*a*. Waist fasteners 114a may be positioned as required along inner and outer front panels 91, 92 to snugly fit gown 90 about the patient's waist. Gown 90 may then be secured about the patient's waist as desired creating belt-like tension across the abdomen, allowing the weight of gown 90 to be carried about her midsection. This allows both left and right upper segments 116, 118 to be simultaneously disengaged from back 93, allowing access to each chest area of the patient while maintaining partial coverage of the patient's body. Such simultaneous access to both breast regions of a patient is beneficial to conducting breast exams.

In an alternative use, the abdominal area may be accessed by releasing waist fasteners 114*a* and lifting outer front panel 92 and inner front panel 91 away from the patient as needed for exposure. Only the lower portion of the patient's anatomy is exposed, thereby reducing patient anxiety and discomfort by minimizing exposure.

Gown 90 may also be used for breast feeding. Either of left and right upper segments 116, 118 may be released from back 93. Thus, access may be gained to either breast while substantially keeping the rest of the wearer's upper body covered.

The invention overcomes those problems associated with prior art gowns. It should however be understood that the just described embodiment merely describes the principles of the invention in a preferred form. Many modifications, additions and deletions, in addition to those expressly recited, may be made without departure from the spirit and scope of the invention as set forth in the following claims.

What is claimed is:

1. A gown comprising:

a front portion having upper and side edges, said front portion being subdivided by a vertically disposed opening such that a left panel and a right panel are defined thereby, each of said left and right panels being subdivided by a horizontally disposed cross slit into an upper portion and a lower portion;

a back portion having upper and side edges, said back portion upper and side edges joined to respective front portion upper and side edges such that a body portion having left and right arm openings and a neck opening is defined thereby; and a strap extending downwardly along the vertically disposed opening of the front portion, said strap being affixed at its uppermost portion to one of said panels generally adjacent said neck opening, said strap including vertically aligned releasable fasteners;

each of said left and right panels including releasable fasteners arranged adjacent the vertically disposed opening, each of said fasteners positioned in mating relationship with a fastener on said strap and releasably fastenable therewith;

said left upper and lower portions each including releasable fasteners arranged adjacent said cross slit, each of the fasteners on said left upper portion being positioned in mating relationship with a fastener on the left lower portion and releasably fastenable therewith; said right upper and lower portions each including releasable fasteners arranged adjacent said cross slit, each of the fasteners on said right upper portion being positioned in mating relationship with a fastener on the right lower portion and releasably fastenable therewith.

2. The gown of claim 1, wherein said cross slit extends between said left arm opening and said right arm opening.

3. The gown of claim 1, wherein the strap is affixed to the uppermost portion of the left upper portion.

4. The gown of claim 3, wherein the lowermost portion of said strap is affixed to the left lower portion.

5. The gown of claim 4, wherein the strap is affixed to said uppermost and lowermost portions by stitching.

6. The gown of claim 4, wherein said right panel fasteners are positioned generally adjacent said vertically disposed opening and extend from the neck opening substantially to a bottom border of the gown.

7. The gown of claim 1, wherein said fasteners comprise plastic snaps.

* * * * *